US005726526A

United States Patent [19]

Martens et al.

[11] Patent Number: 5,726,526

[45] Date of Patent: Mar. 10, 1998

[54] DISPLAY DEVICE HAVING A SUPPORT STRUCTURE FOR A WIRE CATHODE

[75] Inventors: Peter Martens; Johannes C. Driessen; Antonius J. J. Rademakers; Petrus H. F. Trompenaars; Theunis S. Baller; Gerardus G. P. Van Gorkom; Nicolaas Lambert; Siebe T. De Zwart; Edwin A. Montie, all of Eindhoven, Netherlands

[73] Assignee: U.S. Philips Corporation, New York, N.Y.

[21] Appl. No.: 530,501

[22] Filed: Sep. 19, 1995

[30] Foreign Application Priority Data

Sep. 21, 1994 [EP] European Pat. Off. ..... 94202710

[51] Int. Cl.[6] ..... H01J 19/12

[52] U.S. Cl. ..... 313/422; 313/495; 313/497

[58] Field of Search ..... 313/422, 495, 313/497

[56] References Cited

U.S. PATENT DOCUMENTS

| | | | |
|---|---|---|---|
| 4,352,040 | 9/1982 | Andreadakis | 313/584 |
| 4,950,946 | 8/1990 | Van Der Wilk | 313/422 |
| 5,489,815 | 2/1996 | Van Corkom et al. | 313/422 |

FOREIGN PATENT DOCUMENTS

| | | | |
|---|---|---|---|
| 0436997 | 7/1991 | European Pat. Off. | H01J 31/12 |

*Primary Examiner*—Sandra L. O'Shea
*Assistant Examiner*—Vip Patel
*Attorney, Agent, or Firm*—Robert J. Kraus

[57] ABSTRACT

A flat display device is provided with a wire cathode or wire cathodes and with apertures which allow passage of electrons emitted by the wire cathode. The wire cathode is stretched in a wire-cathode support having positioning grooves for the wire cathode. This support engages the element in which the passages are made. The support and the element are provided with corresponding contacting surfaces.

18 Claims, 15 Drawing Sheets

DISPLAY DEVICE HAVING A SUPPORT STRUCTURE FOR A WIRE CATHODE

BACKGROUND OF THE INVENTION

The invention relates to a display device having an envelope comprising a wire cathode for emitting electrons and an element having a row of apertures for allowing passage of electrons emitted by the wire cathode.

Such a display device is known from EP-A 0 436 997.

The apertures allow passage of electrons emitted by the wire cathode. A wire cathode should preferably be and remain accurately positioned relative to the apertures. A change in the relative positions of the wire cathode and the apertures causes an undesired change of the electron flow through the apertures. Such a change in the relative positions generally has an adverse effect on the picture quality.

SUMMARY OF THE INVENTION

It is an object of the invention to provide a display device having an envelope in which the positions of the wire cathode and the apertures change only little with respect to each other.

To this end, the display device in accordance with the invention is characterized in that it comprises at least one wire-cathode support, in that the above-mentioned element and the wire-cathode support engage each other on corresponding contacting surfaces of which the normal extends transversely to the row of apertures, and in that the wire-cathode support has a number of wire-positioning grooves in which the wire cathode rests and between which grooves the wire cathode extends in a self-supporting manner and at some distance from the apertures, the wire-positioning grooves extending in a direction parallel to the row and the contacting surfaces.

The corresponding contacting surfaces and the wire-positioning grooves enable the wire cathode to be accurately positioned relative to the row of apertures, in particular, in a direction transverse to the row of apertures and transverse to the contacting surfaces.

Preferably, the wire-cathode support and the apertured element engage each other, while they are subjected to a pre-tension.

In comparison with embodiments in which the wire-cathode support and the element are secured to each other by means of screws or an adhesive, this has the advantage that the risk of fracture is reduced.

The display device may be provided with a separate pressure spring which ensures that the wire-cathode support and said element engage each other under pre-tension, or said element or the wire-cathode support may be provided with such a pressure spring. The latter alternative has the advantage that the display device has one component less. The term "pressure spring" is to be understood to mean within the scope of the invention, each part or component or collection of parts or components, which ensure(s) that said element and the wire-cathode support are pressed against each other. The "pressure spring" can be formed by the envelope of which a part presses against the wire-cathode support as a result of the pressure difference between the interior of the envelope and the exterior world.

Preferably, the wire-cathode support is flexible in a direction along the row of apertures. This results in an improved contact between the contacting surfaces as compared to an embodiment in which the support is rigid in said direction.

A preferred embodiment of the display device in accordance with the invention is characterized in that said element and the wire-cathode support are provided with additional support-positioning means to determine the relative positions of the wire-cathode support and said element in a direction transverse to the normal to the contacting surfaces. Such additional support-positioning means may comprise a positioning projection and a positioning recess. The terms "positioning projection and positioning recess" are to be understood to mean within the scope of the invention, each pair of elements, one in each of the above-mentioned components (the element and the wire-cathode support), which correspond in shape and engage each other on surfaces which extend transversely to the contacting surfaces. Said element and the wire-cathode support may be provided with a number of said pairs of elements which may have the same shape or a different shape. It is alternatively possible to provide both the wire-cathode support and said element with corresponding support-positioning grooves in a direction transverse to the normal to the contacting surfaces, said support-positioning grooves being positioned opposite each other and a fibre being provided between said grooves.

The additional positioning means enable an even higher accuracy of the positioning of the wire cathode relative to the row of apertures to be obtained, in particular in a direction transverse to the row of apertures and parallel to the contacting surfaces.

A further preferred embodiment of the display device is characterized in that the wire-positioning grooves extend in a side of the wire-cathode support facing the row of apertures. In such an embodiment, the accuracy with which the wire cathode is positioned relative to the row of apertures is higher than in an embodiment in which the positioning grooves are formed, for example, in a side facing away from the row of apertures.

The positioning grooves preferably comprise two surfaces which extend so as to form a corner, the wire cathode engaging the corner formed by said surfaces. By virtue thereof, the position of the wire cathode in the groove is more accurately defined.

A still further embodiment of the display device in accordance with the invention is characterized in that the wire-cathode support supports at least two parallel wire cathodes and in that said element comprises rows of apertures corresponding to these two wire cathodes.

By virtue thereof, fewer components are used in a display device which comprises more than one wire cathode, and the accuracy with which the wire cathodes are positioned relative to the apertures and relative to each other is improved.

Another embodiment of the display device in accordance with the invention is characterized in that the display device comprises more than one wire cathode and all wire cathodes are situated on one wire-cathode support.

This wire-cathode support comprises all wire cathodes. This results in a reduction of the number of components to be used. In addition, the wire-cathode support can be manufactured as a separate component. This results in lower costs.

Preferably, a pre-tension is exerted on the wire cathode situated in the wire-positioning grooves, said pre-tension comprising a component in the longitudinal direction of the wire cathode and a component extending transversely to said direction.

In operation, the temperature of the wire cathode increases. This leads to a lengthening of the wire cathode. The component exerting the pre-tension in the longitudinal direction and the component extending transversely thereto ensure that the wire cathode remains taut between the positioning grooves.

In embodiments, the wire-cathode support comprises tensioning springs to produce the pre-tension.

By providing the wire-cathode support with such tensioning springs, the construction has become simpler and more suited for mass-production, as compared to embodiments in which the tensioning springs are not secured to the wire-cathode support.

BRIEF DESCRIPTION OF THE DRAWING

These and other aspects of the invention will be explained in greater detail by means of the following drawing figures, in which the same reference numerals generally refer to the same parts.

The Figures are not drawn to scale. Generally, like reference numerals refer to like parts.

DESCRIPTION OF THE PREFERRED EMBODIMENTS

Figure 1A:
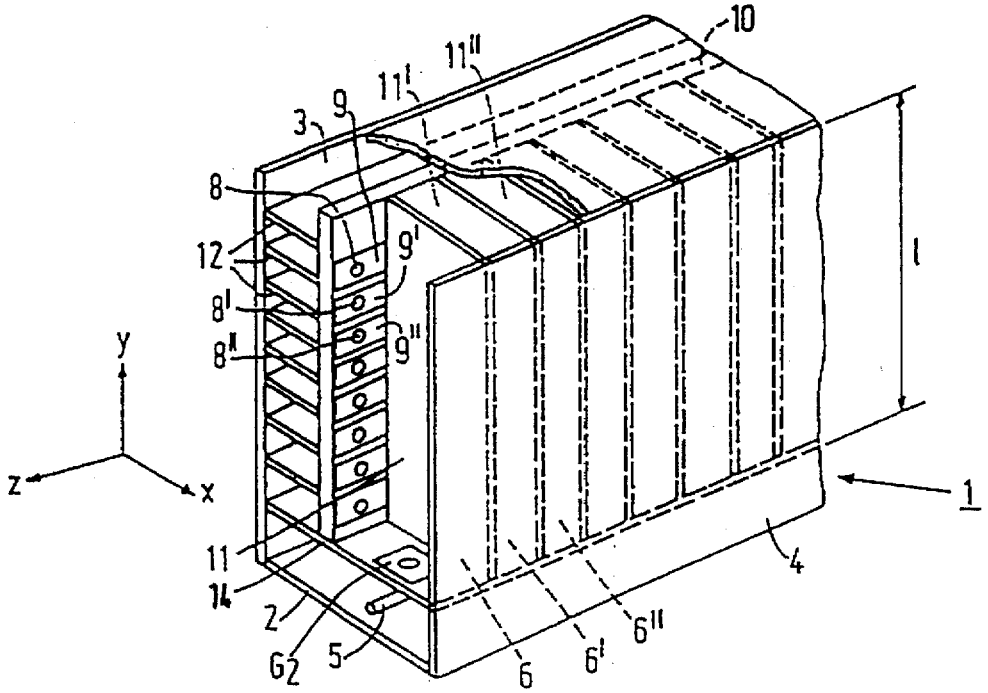
FIG.1A PRIOR ART
FIGS. 1A and 1B are a partly perspective view and a cross-sectional view, respectively, of a display device comprising a wire cathode.
Figure 1B:
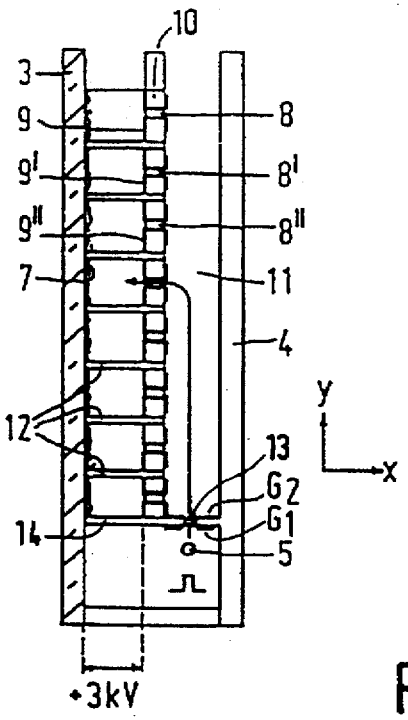
FIG.1B PRIOR ART

FIGS. 1A and 1B are, respectively, a partly perspective view and a sectional view of a display device 1 having an envelope, in this example a display device of the so-called flat-panel type in which the invention can particularly advantageously be used. Display device 1 has a transparent front wall (window) 3 and an oppositely located rear wall 4. An electroluminescent screen 7 is provided on the window 3. Electron-transport ducts 11, 11', 11", which are used to transport electrons, extend in a direction parallel to the rear wall, for example the y-direction. In this example, the electrons are transported through a transport duct 11 by applying a potential difference across the transport duct. The display device further comprises means for extracting electrons from the transport ducts 11 at predetermined locations. In this example, said means are constituted by the apertures 8, 8', 8" in co-operation with electrodes 9, 9', 9" on walls 10. The display device further comprises means for directing electrons towards the luminescent screen. In this example these means comprise the electrodes 9 and the luminescent screen 7 between which a potential difference is applied. Partitions 12 are provided, in this example, between the walls 10 and the window 3. The display device further comprises a bottom wall 2.

The display device comprises a wire cathode 5 and electrodes G1 and G2. These electrodes are situated around and/or inside apertures 13 in element 14. This element 14 will hereinafter be referred to as "apertured wall" or "wall". This is not to be interpreted in a limiting sense; the term "apertured wall" is used only to improve the readability of the following text and to avoid confusion with other elements. The wire cathode is provided at some distance from the apertures 13. In this example, the wire cathode 5 and the electrodes $G_1$ and $G_2$ form a triode. The display device comprises feed-throughs (not shown) to apply potential differences between the wire cathode and the $G_1$ and $G_2$ electrodes. By heating the cathode 5 and applying a potential difference between the cathode and the $G_2$ electrode, and by applying a control voltage to the $G_1$ electrodes, electrons are introduced into the transport ducts 11, the electron flow being controlled by the control voltage.

The electron flow in a transport duct 11 is also determined by the position of the wire cathode 5 relative to the apertures 13 in the apertured wall 14. The more accurately the relative positions of the wire cathode 5 and the apertures 13 are defined, the better the electron flow in a transport duct 11 can be controlled. It is an object of the invention to provide a display device in which the wire cathode can be accurately positioned relative to the row of apertures.

Figure 2A:
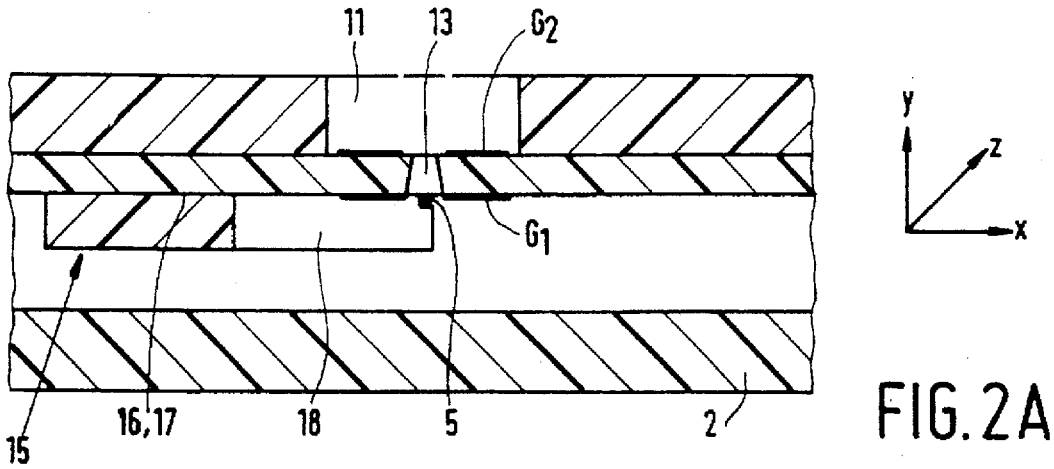
FIGS. 2A up to and including 2E are sectional views of a detail of a display device in accordance with the invention.
Figure 2B:
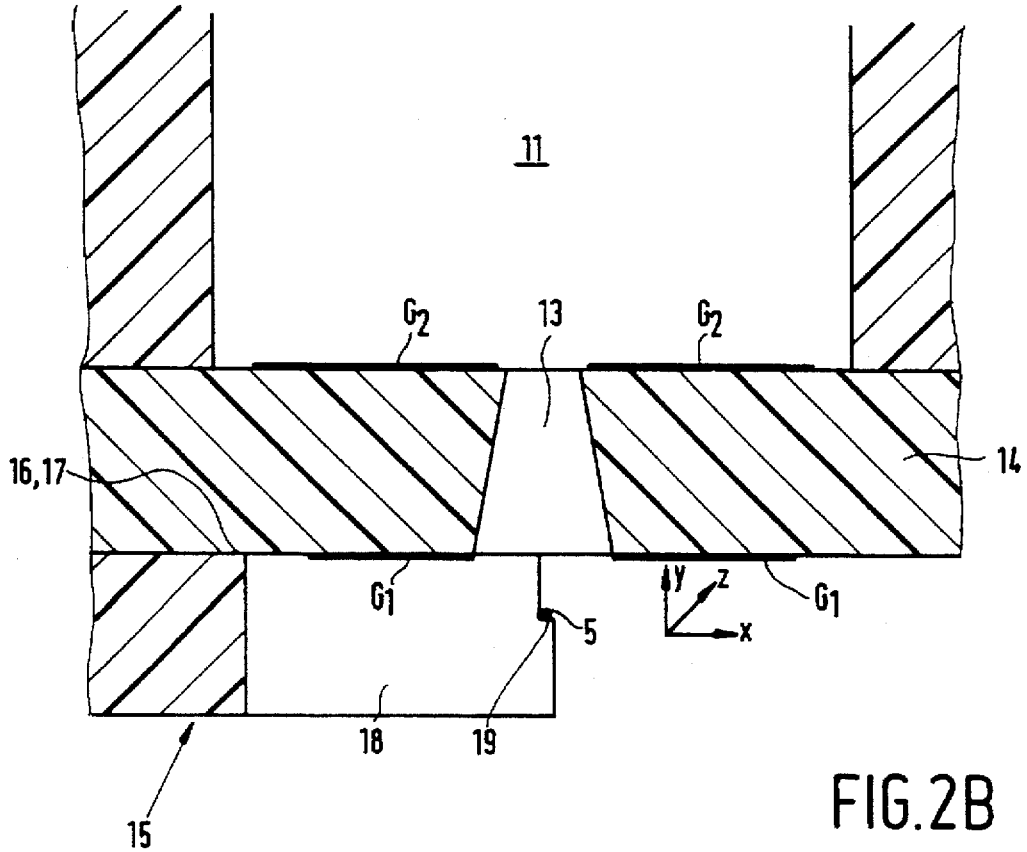
Figure 2C:
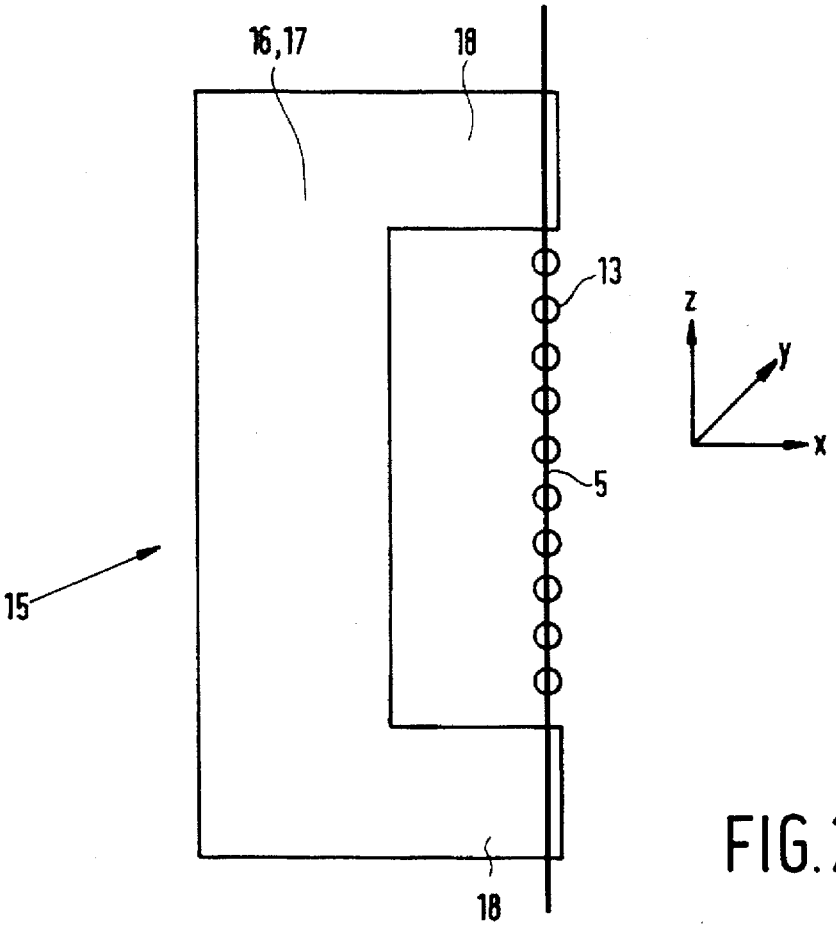
Figure 2D:
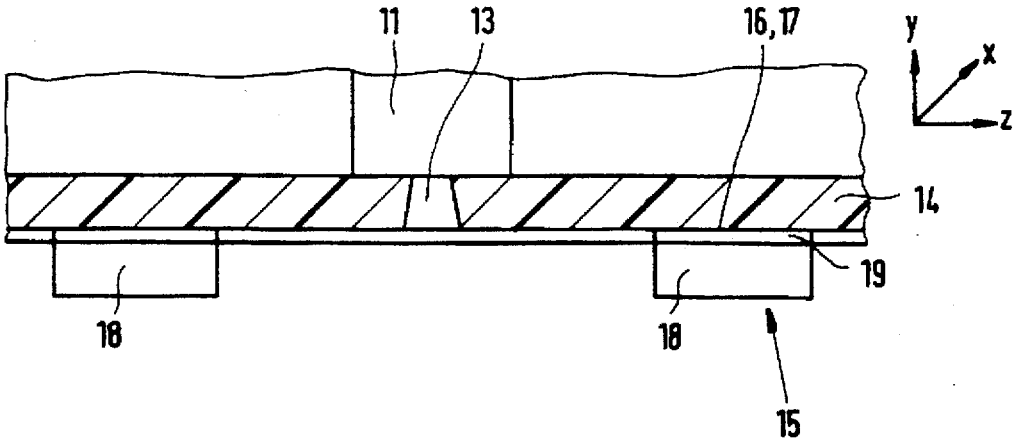
Figure 2E:
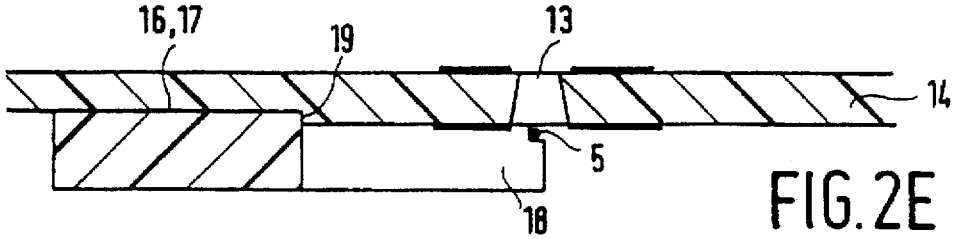

FIGS. 2A up to and including 2D are sectional views of a detail of a display device in accordance with the invention. In FIGS. 1B and 2A up to and including 2D, the direction along the wire cathode is indicated by the z-direction, the direction along the ducts by the y-direction, and the x-direction represents the direction perpendicular to the y and the z-directions. In particular the position of the wire cathode in the y-direction is important, because this position determines the distance between the wire cathode and the apertures in wall 14. Slightly less important is the position of the wire cathode in the other directions, particularly in the x-direction, i.e. a direction transverse to the row of apertures. FIGS. 1B, 2A and 2B are sectional views in the x-y plane, FIG. 2C is a sectional view in the z-x plane and FIG. 2D is a sectional view in the y-z plane. Wall 14 comprises a row of apertures 13 on either side of which and/or partly inside the apertures there are, in this case, electrodes G1 and G2. Wire cathode 5 is situated at some distance (viewed in the y-direction) from the apertures. Parts 18 of the wire-cathode support 15 are provided with wire-positioning grooves 19. The wire cathode 5 is positioned in these grooves 19 and extends between the grooves 19 in a self-supporting manner, in the y-direction, at some distance from the row of apertures 13. The positioning grooves extend in the z-direction. The wall 14 and the wire-cathode support 15 are provided with corresponding contacting surfaces 16 and 17 extending in the z-x direction. The normal to these surfaces extends in the y-direction, i.e. transverse to the row of apertures extending in the z-direction. The contacting surfaces in the z-x direction and the positioning grooves in the z-direction accurately determine the position of the wire cathode in the y-direction. The grooves 19 are preferably in line with the row of apertures. Preferably, the entrance surfaces of the apertures 13 facing the wire cathode 5 and the contacting surface 17 of wall 14 extend in one plane, as shown in FIGS. 2A up to and including 2D. FIG. 2E shows an embodiment in which the contacting surface and the entrance surface 18 of the apertures 13 do not extend in one plane. In this embodiment, the contacting surfaces 16, 17 extend so as to be slightly recessed with respect to the entrance surface of the apertures 13. The disadvantage of such a construction relative to a construction as shown in FIGS. 2A up to and including 2D is that an additional edge 19 has to be made in wall 14. An inaccurately dimensioned edge results in a variation of the distance between the entrance surface and wire cathode 5. If the edge 19 is sufficiently accurately manufactured, this disadvantage can be turned into an advantage if the edge 19 is used to determine the position of the wire-cathode support 15 in the x-direction, by providing the wire-cathode support with an edge which engages and corresponds to the edge 19.

Figure 3A:
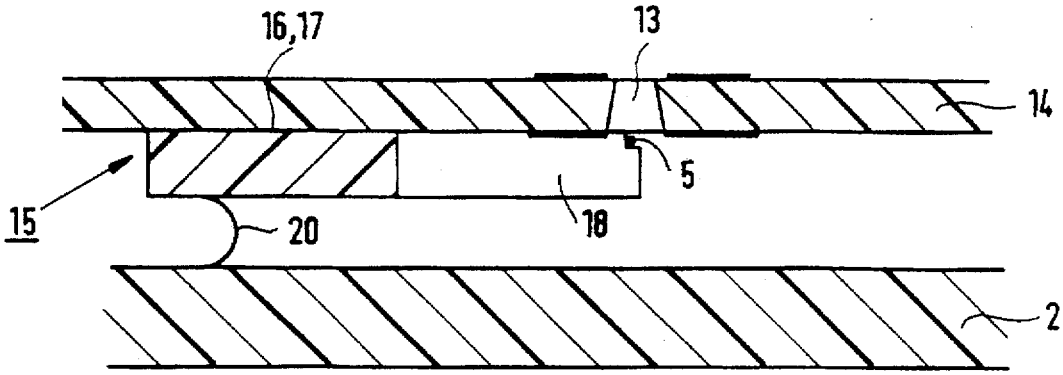
FIGS. 3A up to and including 3C are sectional views of a detail of a further embodiment of the display device in accordance with the invention.
Figure 3B:
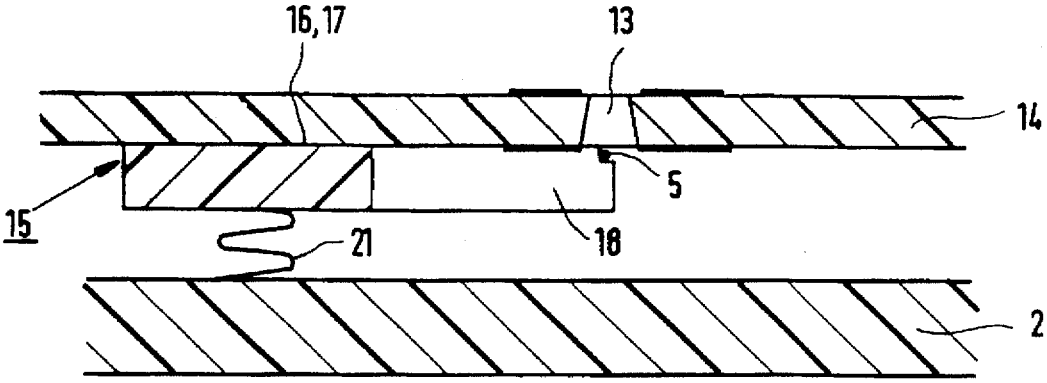
Figure 3C:
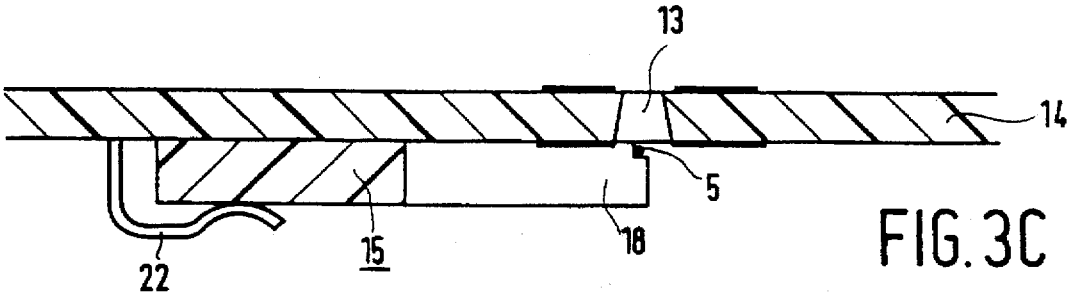

It is possible to secure the wire-cathode support 15 and the wall 14 to each other, for example, by means of soldering, screwing or by means of an adhesive. In the manufacture of a display device, however, high temperatures may occur. The resultant thermal stresses may cause fracture. However, the element 14 and the wire-cathode support preferably engage each other under pre-tension. By virtue thereof, the effect of thermal stresses is at least partly compensated for, thereby reducing the risk of fracture. FIG. 3A shows an embodiment in which the wire-cathode support is provided with a spring element 20, hereinafter also referred to as "pressure spring", which is compressed against wall 2 and, consequently, pushes the wire-cathode support and the wall 14 against one another. FIG. 3B shows an embodiment in which the display device comprises a separate spring element, i.e. pressure spring 21. In these examples, the pressure spring (20, 21) is compressed against wall 2. FIG. 3C shows an embodiment in which the wire-cathode support 15 is pressed against wall 14 by means of a pressure spring 22 which is secured to the wall 14. The "pressure spring" may be formed by the envelope, a part of which presses on the wire cathode as a result of the difference in pressure between the interior of the envelope and the exterior world.

Preferably, the wire-cathode support exhibits a certain degree of flexibility in the direction along the row of apertures (z-direction). By virtue thereof, the accuracy with which the corresponding contacting surfaces engage each other is improved.

The wire-cathode support and the element in which the apertures are formed (wall 14) are preferably made of materials having a similar coefficient of thermal expansion, and wherever possible of the same material. By virtue thereof, changes in the position of the wire cathode relative to the apertures are at least partly counteracted. Preferably, at least one of the contacting surfaces is an insulating surface.

Figure 4A:
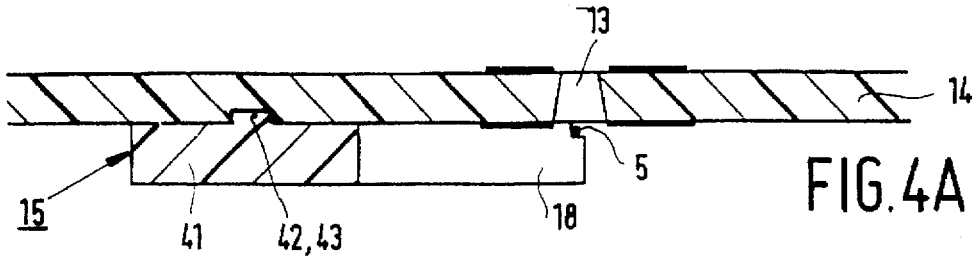
FIGS. 4A, 4B and 4C are sectional views of a further preferred embodiment.
Figure 4B:
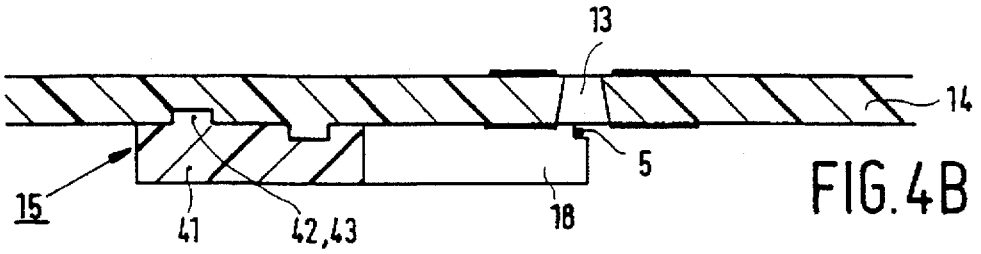
Figure 4C:
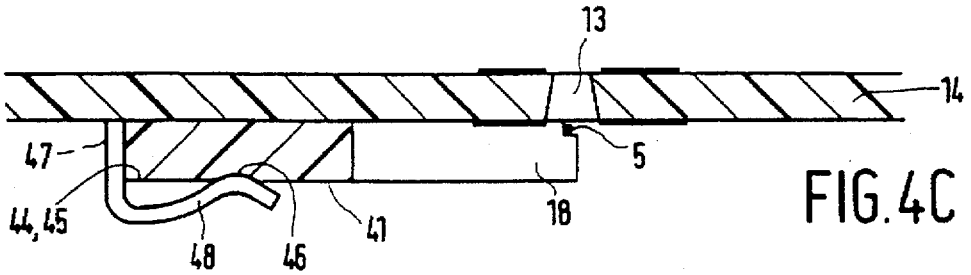

FIGS. 4A and 4B are sectional views of a further, preferred embodiment. In this example, the wire-cathode support 41 and the wall 14 are provided with a positioning recess 42 and a positioning projection 43. This enables the position of the wire cathode relative to the row of apertures to be further defined, more particularly in the x-direction. The terms "positioning projection and positioning recess" are to be understood to mean within the scope of the invention, each pair of elements, one in each of the components mentioned (the element and the wire-cathode support) which correspond in shape and engage each other on surfaces extending transversely to the contacting surfaces. The element and the wire-cathode support may be provided with a number of such pairs which may be equal or different in shape. More particularly, a wire-cathode support may be provided, for example, with one projection and one recess, and the apertured wall may be provided with a corresponding recess and projection, as shown in FIG. 4B. FIG. 4C shows an embodiment in which the determination of the position of the wire-cathode support in the z- and x-directions (=the function of the positioning recesses and projections in FIGS. 4A and 4B) takes place by means of contacting surfaces 44 and 45 of, respectively, the wire-cathode support 41 and element 47 (for the z-direction) and by means of grooves or ducts 46 in wire-cathode support 41 with which the resilient end portion 48 of element 47 engages.

Figure 5:
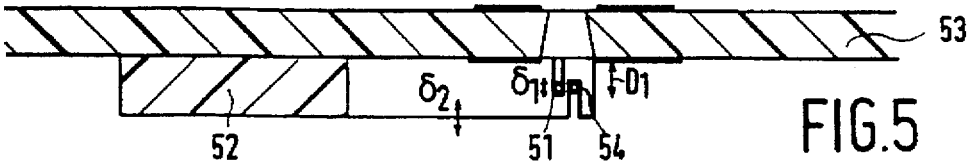
FIG. 5 shows the relative positions of the positioning grooves, wire-cathode support and support.

The above examples show wire-cathode supports comprising wire-positioning grooves in a surface facing the row of apertures. They are preferred embodiments. The wire-positioning groove may alternatively be formed in a surface facing away from the row of apertures. However, the accuracy with which the wire cathode is positioned relative to the row of apertures is greater if the wire-positioning grooves are formed in a surface facing the support. This is shown in FIG. 5. This Figure shows two different ways of forming a positioning groove in a wire-cathode support 52: groove 51 is formed in a surface facing the holes in wall 53, and groove 54 is formed in a surface facing away from the wall 53. In either case, the distance between the wire cathode and the apertures is ideally D1. In practice however there is always a deviation from the distance D1. For groove 51 the distance is determined by the accuracy with which the depth of the groove is formed (∂1), for groove 54, the distance is determined by the accuracy with which the depth of the groove can be formed (∂1) and the accuracy with which the thickness of the wire-cathode support can be formed (∂2) at the location of the groove.

The above examples show positioning grooves having two surfaces which extend so as to form a sharp corner. These embodiments are preferred to, for example, embodiments in which the groove is U-shaped, because the position of the wire cathode in the positioning groove is better defined.

Figure 6:
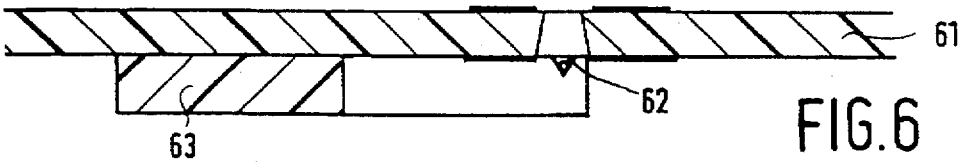
FIG. 6 shows a further preferred embodiment, in which the positioning groove is V-shaped and extends towards the support.

FIG. 6 shows a further preferred embodiment. In this example, the positioning groove 62 in the wire-cathode support 63 is V-shaped, the V-shape extending towards the wall 61.

Figure 7:
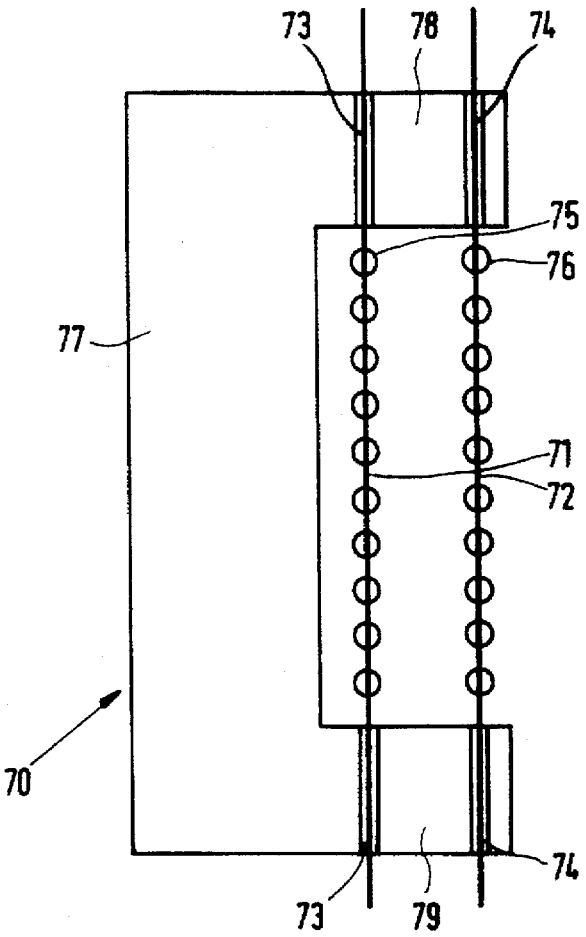
FIG. 7 is a top view of a wire-cathode support comprising two parallel wire cathodes.

FIG. 7 is a top view of a wire-cathode support for a further embodiment. In this embodiment of the display device, the support 70 comprises two parallel wire cathodes 71 and 72 and corresponding positioning grooves 73 and 74. The apertured wall exhibits corresponding rows of apertures 75 and 76. This embodiment is preferred to an embodiment in which the display device comprises two wire-cathode supports, because fewer parts are necessary, which is favourable for mass-production and for the accuracy with which the wire cathodes are positioned relative to each other and relative to the corresponding rows of apertures. FIG. 7 shows a wire-cathode support having contacting surfaces 77, 78 and 79. The contacting surfaces 78 and 79 are situated on either side of the wire cathode(s) and positioning grooves are formed in these contacting surfaces. It is favourable to form the positioning grooves in the contacting surfaces, as the distance between the wire cathode and the support is then directly determined by the depth of the positioning grooves and the distance between the contacting surfaces and the positioning grooves is minimal. Preferably, the surfaces in which the wire-positioning grooves are formed are the only contacting surfaces, the rest of the support does not contact the element. This results in an improved accuracy with which the distance (in the y-direction) between the wire cathode(s) and the element can be determined.

Figure 8:
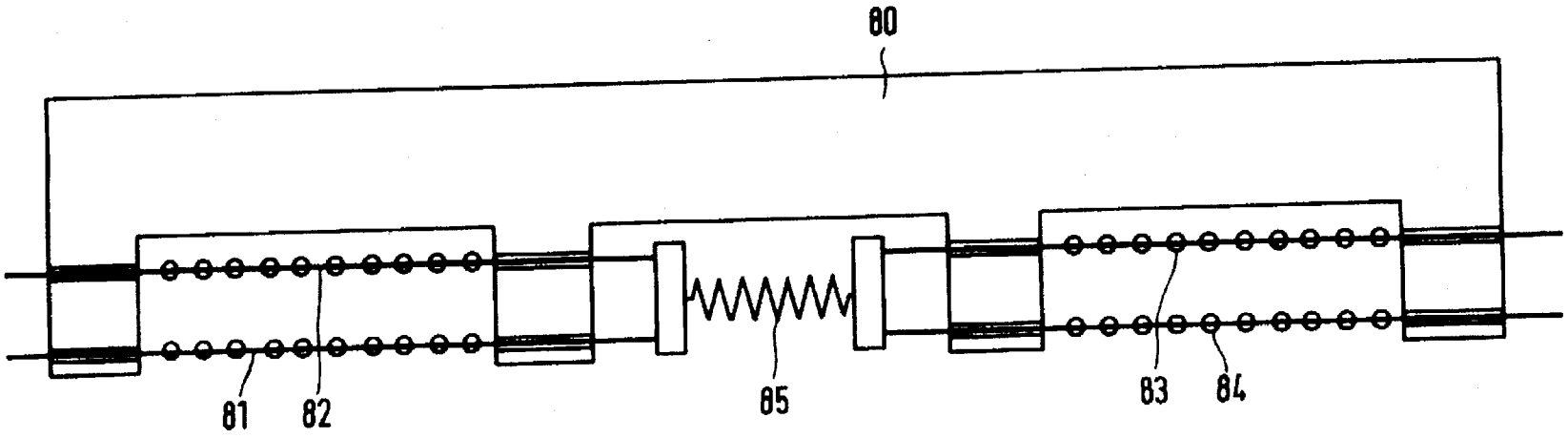
FIG. 8 shows another embodiment in which the wire-cathode support comprises all the wire cathodes of a display device.

FIG. 8 shows yet another embodiment in which the wire-cathode support comprises all wire cathodes 81, 82, 83, 84 of a display device. The wire cathodes are interconnected by means of springs 85.

This results in a substantial reduction of the number of different components of the display device.

Figure 9:
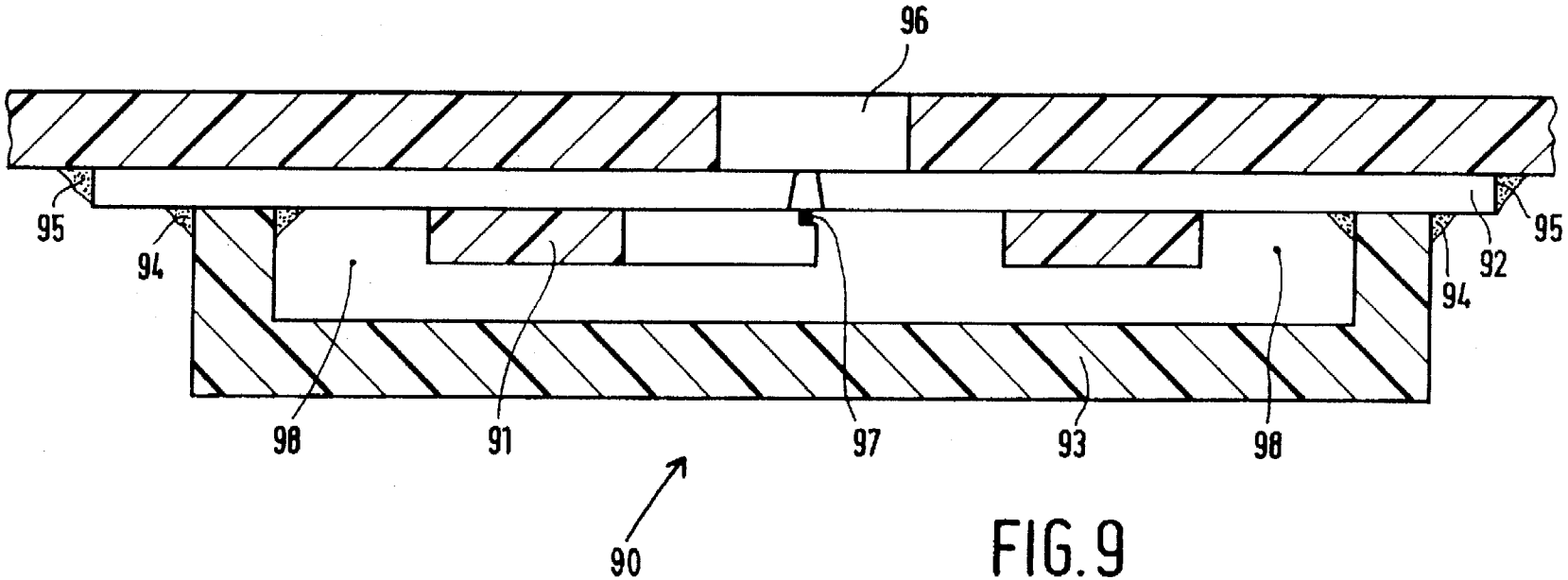
FIG. 9 shows an embodiment in which the display device has a separate unit which comprises the wire-cathode support and the support as well as an envelope for both.

Yet another embodiment is shown in FIG. 9. In this embodiment, a separate unit 90 is formed which comprises the wire-cathode support 91 and the wall 92 as well as an envelope 93. In this example, the envelope 93 is secured to wall 92 by means of connections 94. This separate unit 90 is secured to the rest of the display device by means of connections 95. Transport ducts 96 are formed in the rest of the display device. The advantage of the use of a separate wire-cathode unit or module, including the apertures in the wall 92 and means for determining the position of the wire cathode 97 with respect to the apertures, in this case formed by the contacting surfaces and the positioning grooves, is that it enables the display device to be modularly constructed, i.e. one and the same wire-cathode unit can he used for various types of display devices. This results in a saving of costs. The use of a wire-cathode unit has the additional advantage that it permits a number of aspects of the wire-cathode unit, such as the position of the wire cathode relative to the corresponding apertures, to be separately checked. Should the wire-cathode module fail to meet the requirements, the wire-cathode module may be unfit for use, but not the entire display device. By virtue thereof, the costs of breakdown as a result of the fact that the arrangement of the wire cathode relative to the corresponding apertures does not meet the requirements are reduced. As the costs caused by breakdown are reduced, the requirements can be strengthened, which results in a higher average accuracy of the positioning of the wire cathode relative to the corresponding apertures. The wire-cathode module preferably comprises one or more getters 98. By virtue thereof, a good vacuum can be obtained in operation. The position of the getter(s) relative to the wire cathode is preferably such that the wire cathode is shielded from the getter. In this example, the wire cathode is shielded from the getter by the wire-cathode holder. By virtue thereof, it is precluded that the getter material adversely affects the properties of the wire cathode.

It is the aim of the above-mentioned embodiments to provide a display device having one or more wire cathodes, such wire cathode(s) being accurately arranged, in the cold state, relative to the corresponding apertures.

In operation, the wire cathode(s) is (are) heated to emit electrons. This causes the wire cathodes to expand. This may adversely affect the positioning of the wire cathode(s) relative to the apertures. In addition, the wire cathode may start vibrating (microphony). This may also adversely affect the positioning of the wire cathodes relative to the apertures.

In embodiments of the display device in accordance with the invention, measures are taken to reduce the above-mentioned adverse effects.

Figure 10:
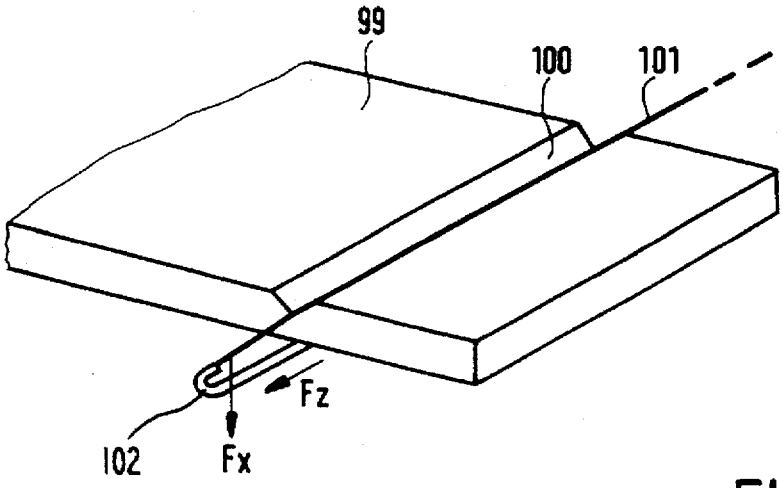
FIG. 10 is a schematic, sectional view of a positioning groove accommodating a wire cathode.

FIG. 10 is a schematic perspective view of a part of a wire-cathode support 99 and a positioning groove 100 accommodating a wire cathode 101. The wire cathode is subjected to a pre-tension comprising a component $F_z$ in the longitudinal direction of the wire (z-direction) and a component in a direction transverse to the longitudinal direction of the wire cathode (y-or x-direction). The component in the z-direction keeps the wire cathode taut when the temperature is increased, the component in the y-or x-direction holds the wire cathode in the positioning groove. In this example, the pre-tension is exerted by a spring element 102 which is secured to the wire-cathode support. This tensioning spring 102 tautens the wire cathode by exerting a force on the wire cathode in both the z-direction and the x-direction.

Figure 11A:
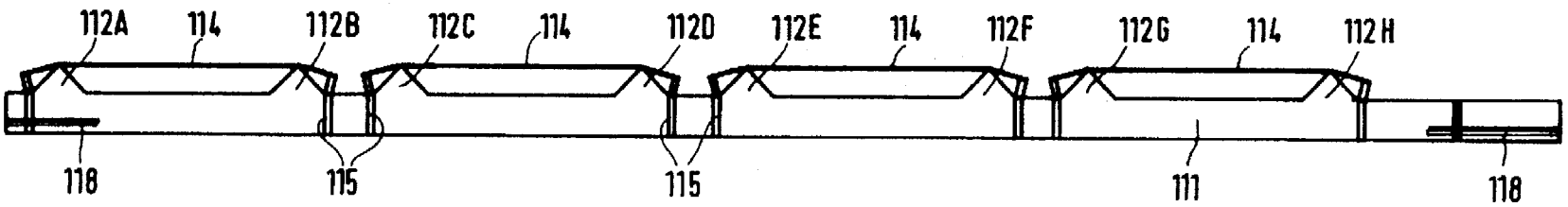
FIGS. 11A, 11B, 11C, 11D and 11E show a further embodiment.
Figure 11C:
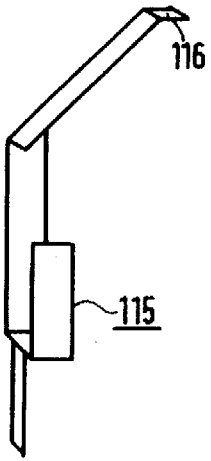
Figure 11B:
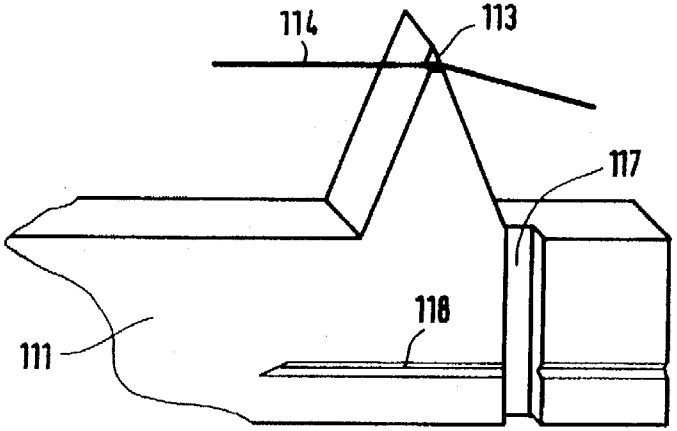

FIGS. 11A, 11B and 11C show an embodiment in which support 111 comprises points 112A to 112H having positioning grooves 113. These positioning grooves 113 accommodate a wire cathode 114. The support comprises spring elements 115 which, in this example, take the form of tensioning springs. At the location of reference numeral 116, the spring elements 115 are connected to the wire cathodes and the spring elements draw the wire cathode 114 into the positioning grooves 113. The wire-cathode support is provided with grooves 117 for accommodating the tensioning springs 115 and with positioning grooves 118. In FIGS. 11A up to and including 11C, each wire cathode 114 is pulled taut by two springs 115.

Figures 11D, 11E:
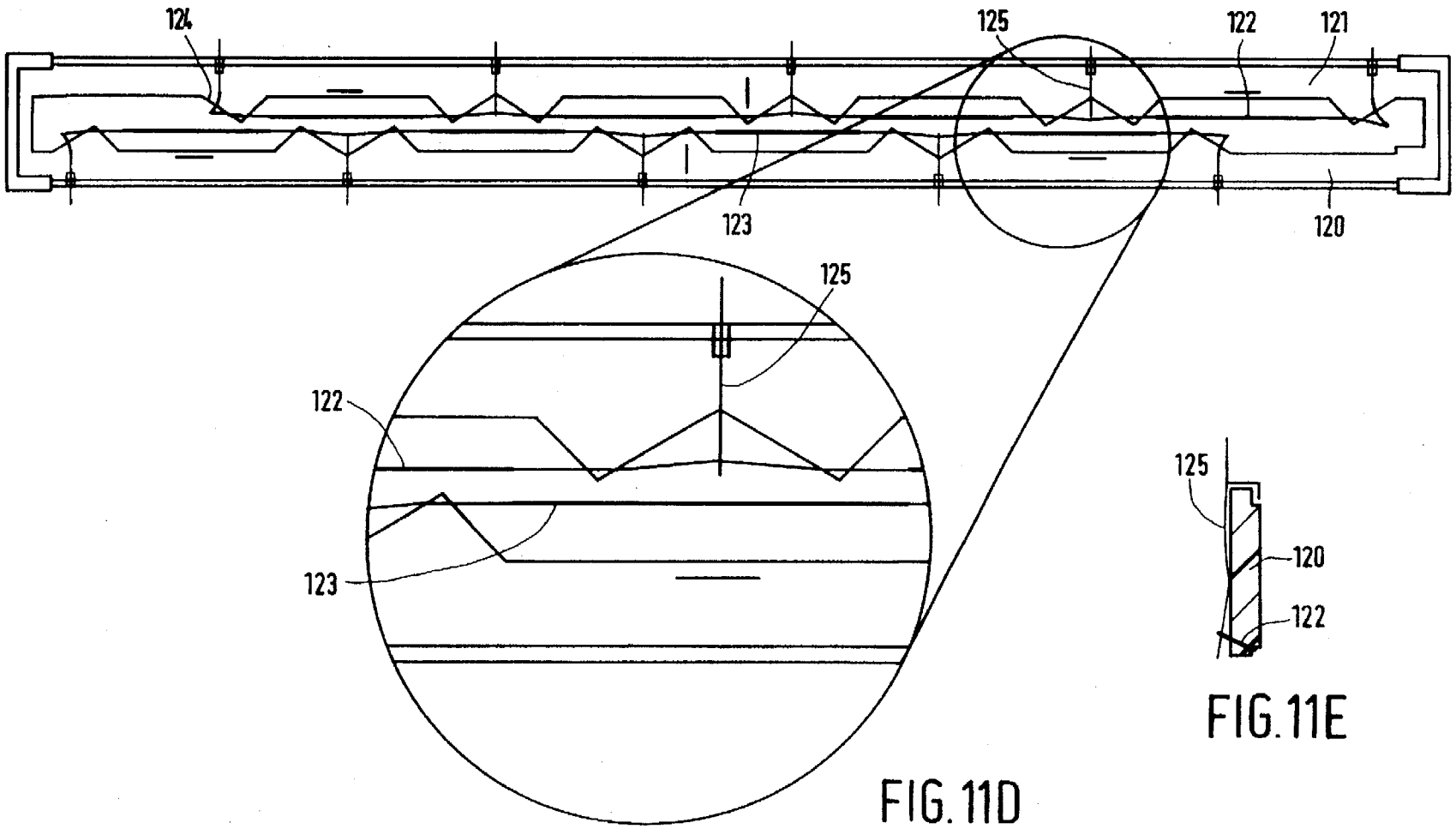

FIGS. 11D and 11E show a further embodiment. In this embodiment, the wire-cathode support comprises two sub-supports 120 and 121. Two wire cathodes 122 and 123 are present on the support. This embodiment differs from the one shown in FIGS. 11A up to and including 11C in that one continuous wire cathode corresponds to a plurality (in this example four) rows of apertures. Consequently, the number of wire cathodes is reduced. The wire cathodes extend through a plurality (in this case 2n, where n=4) positioning grooves. The support has two different types of tensioning springs, i.e. end springs 124 and intermediate springs 125. The number of tensioning springs is reduced from 2n to n+1. At least two positioning grooves have a common intermediate spring.

Figures 12A, 12B:
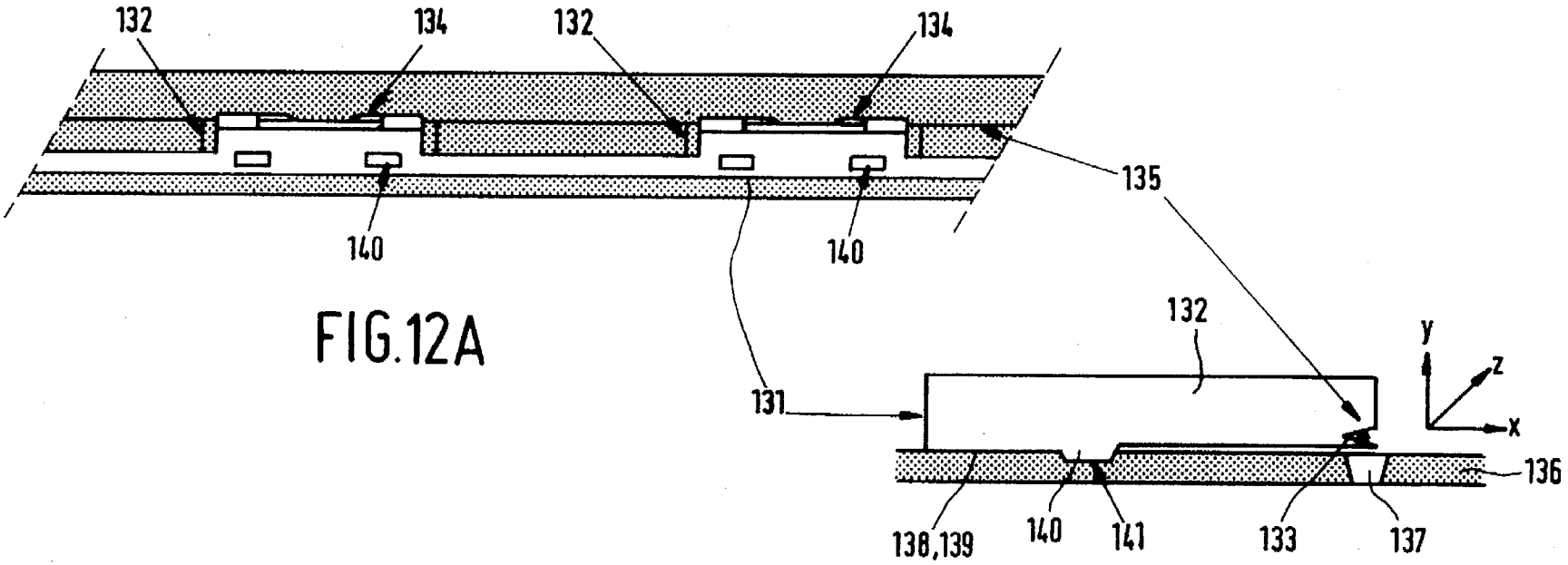
FIGS. 12A and 12B show a detail of an embodiment of the display device in accordance with the invention.

FIGS. 12A and 12B show a detail of an embodiment of the display device in accordance with the invention. The wire-cathode support 131 comprises a number of spring elements 132 having a groove 133 and tensioning springs 134 for stretching the wire cathode 135. The elements 132 extend transversely to the wire cathode. The wire-cathode support 131 and the wall 136 having apertures 137 are provided with contacting surfaces 138 and 139 and with positioning projections 140 and positioning recesses 141. In this example, the positioning projections take the form of spring elements which engage with cavities 141. The wire-positioning grooves 133 extend in one line (z-direction) parallel to the contacting surfaces (in x-z direction) 138, 139. The wire cathode 135 is drawn into the wire-positioning grooves 133 by means of the tensioning springs 134. If the wire cathode expands, the wire-positioning groove adjusts to the expansion of the wire as a result of the resilient effect of the elements 132 in which the wire-positioning grooves 133 are formed. The advantage of such an arrangement in which the wire-positioning grooves are formed in spring elements which can adjust to an expansion of the wire cathode is that abrasive wear of the wire cathode in the positioning grooves does no longer occur or occurs to a much lesser extent. A disadvantage relative to an embodiment in which the positioning grooves are formed in contacting surfaces is that the positioning in "the cold state" is slightly less accurate.

Figure 13A:
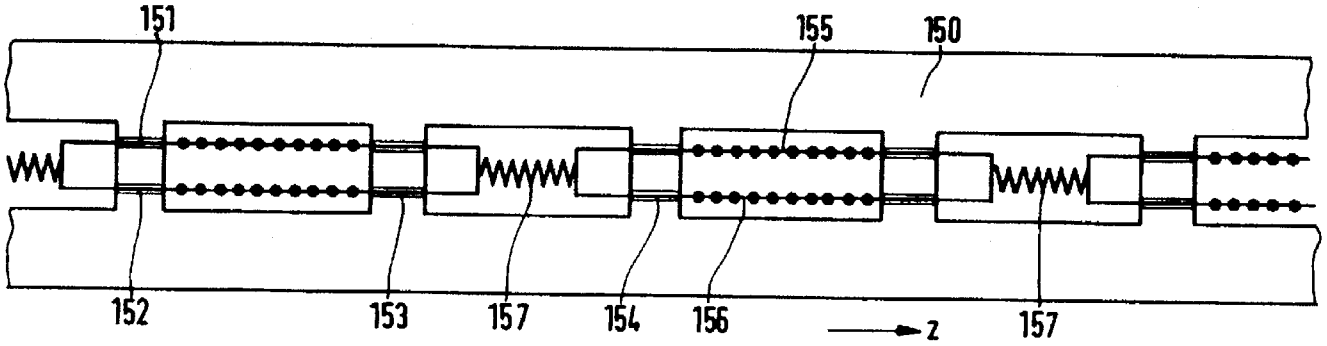
FIGS. 13A, 13B and 13C show a detail of an embodiment of the display device in accordance with the invention.
Figure 13B:
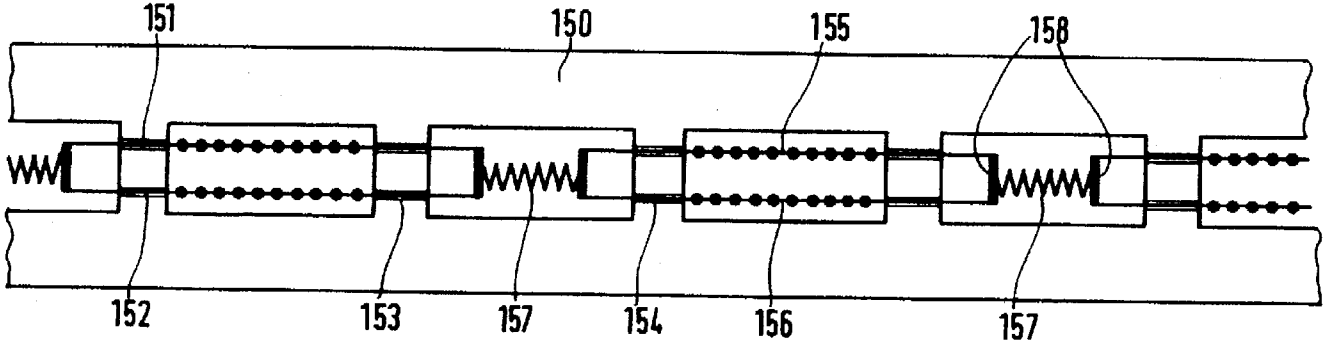
Figure 13C:
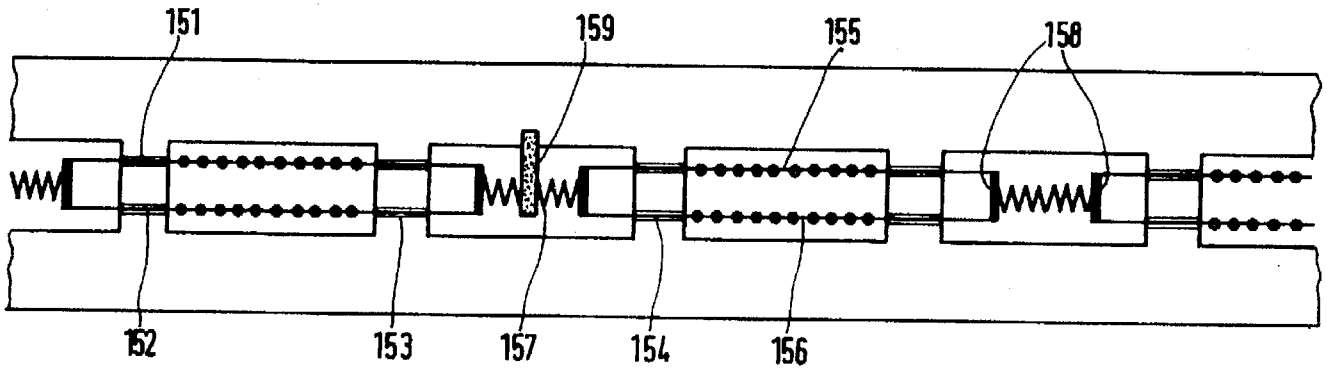

FIGS. 13A, 13B and 13C show details of a preferred embodiment of the display device in accordance with the invention. FIG. 13A shows a wire-cathode support 150 in which positioning grooves 151,152 are formed by twos in parts 153, 154. These grooves accommodate pairs of wire cathodes 155, 156. Each pair of wire cathodes is connected to a tensioning spring 157. In this construction, the number of necessary tensioning springs for 2n wire cathodes (=n pairs of wire cathodes) is reduced to n+1. Thus, FIG. 13A shows wire cathodes which are secured in pairs (pair to pair). It is possible to connect more than two wire cathodes to a tensioning spring. Preferably, however, a coupling element 158 (see FIG. 13B) is secured to a pair of wire cathodes, and the tensioning spring is secured to the coupling element, preferably, in the centre (relative to the pair of wire cathodes). Any differences in thermal expansion between the wire cathodes is compensated for by the natural flexibility of the tensioning spring. The coupling elements can rotate a little. The tensioning spring 157, preferably, also serves as an electrical contact between the wire cathodes. The tensioning spring enables a large tensile force in the direction of the wire cathodes to be attained. In this example, the support comprises a second spring 159 (FIG. 13C) which exerts a force on the tensioning spring 157 in a direction transverse to the longitudinal direction of the wire cathode. This force is relatively small (as compared to the tensile force of the tensioning spring 157). Advantageously, the spring elements used to generate longitudinal forces for tightening the wire cathodes (springs 157) differ from the spring elements used to generate forces acting in a direction transverse to the longitudinal forces (springs 159). The ratio between the necessary forces is so great that it is very difficult to sufficiently accurately generate both forces in one spring element. A possible consequence may be that the force used to draw the wires into the grooves is larger than necessary. Expansion and shrinkage of the wire cathode causes the wire cathode to chafe in the groove; this results in some degree of wear which causes the position of the wire cathode relative to the apertures to change. By using different spring elements for tightening the wire cathodes and for drawing the wire cathodes into the wire-positioning grooves, the force used to draw the wire cathode into a groove can be more accurately determined. By virtue thereof, there is only little wear on the grooves and hence any change in the position of the wire cathode relative to the apertures is small. The springs 159 can also be used as an electrical contact.

FIGS. 13A up to and including 13C illustrate a preferred embodiment in which a number of wire cathodes are interconnected by means of spring elements 157. In these Figures, pairs of wire cathodes are interconnected. This is not to be interpreted in a limiting sense, single wire cathodes can also be interconnected by means of tensioning springs 157.

Interconnecting the wire cathodes has the advantage, relative to the use of two tensioning springs, i.e. one on either side of the wire cathode(s), that the number of tensioning springs 157 to be used is reduced. A further advantage is that each wire cathode is subjected to approximately a similar tensile stress. This has the important advantage that each wire cathode expands in approximately the same manner and that the rate of wear of each groove is substantially equal. An additional advantage is that, apart from the end-tensioning springs, the tensioning springs 157 exert no or hardly any force on the wire-cathode support. In a construction in which the tensioning springs transmit the tensile force to the support, the support may be subject to bending which adversely affects the accuracy with which the wire cathode is positioned. The tensile force has to be transmitted only to the end portions of the support, resulting in fewer, troublesome restrained portions. Further, the wire cathodes do not have to bend. The tensioning spring may have a zigzag construction, allowing the available space to be used effectively, and (if pairs of wire cathodes are used) the spring to project from one side. If coupling elements are used, the wire cathodes can first be accurately secured to the coupling elements, for example, by welding. The pairs of wire cathodes can be mounted on the support by tightening the wire cathodes by means of an auxiliary tool, whereafter pre-tensioned tensioning springs are welded to the coupling elements.

Figure 13D:
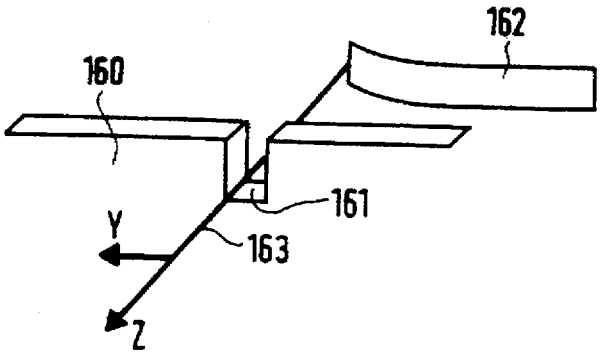
FIGS. 13D up to and including 13H show a detail of an embodiment of the display device in accordance with the invention.
Figure 13E:
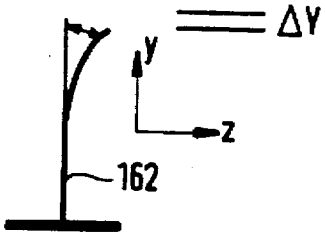
Figure 13F:
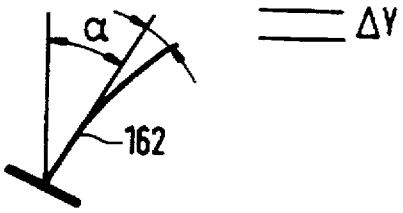
Figure 13G:
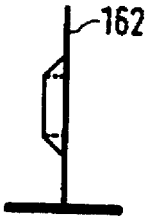
Figure 13H:
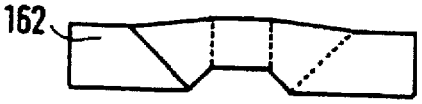

An alternative solution to excessive wear on the wire-cathode support is given by constructions in which the shape of the spring is such that, in the cold state, the wire cathode does not engage the groove. The tensioning spring is formed so that when the wire becomes hot, and consequently expands, the wire moves towards the groove. Thus, only in the hot state the wire engages the groove. FIGS. 13D shows support 160 having a groove 161. In the cold state, the wire cathode 163 does not contact the groove 161. A movement in the y-direction can be made by using a leaf spring 162. The point of the leaf spring moves in the z-direction as well as in the y-direction ($\Delta y$) (see FIG. 13E). If necessary, the leaf spring can be mounted at an angle $\alpha$, so that a larger movement in the y-direction occurs (see FIG. 13F). Movement in the z-direction is possible by (see FIG. 13G) arranging a part of the spring at an angle (a twisted spring). If such a spring bends, then the oblique portion will only bend at right angles to its plane and hence will undergo a small displacement in the z-direction. The above embodiments have in common that, in the cold state, the wire cathode does not contact the groove, whereas in the hot state the wire cathode engages the groove. By virtue thereof, wear on the wire-cathode support is limited.

Figure 14A:
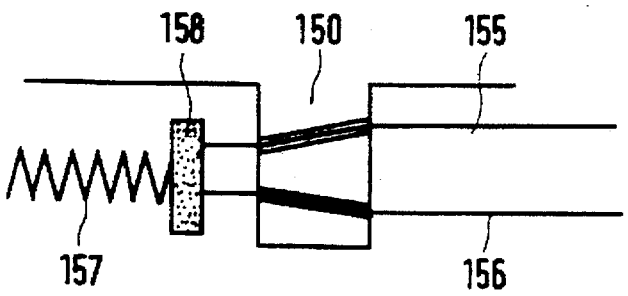
FIGS. 14A and 14B show details of an embodiment of the display device in accordance with the invention.
Figure 14B:
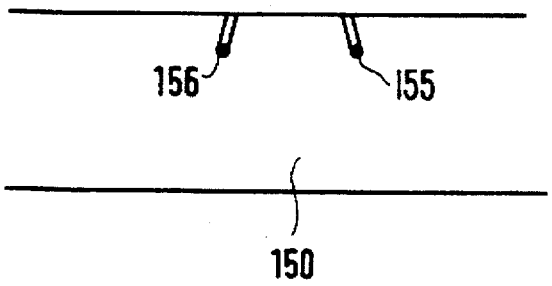

As described hereinabove, the wire-positioning grooves extend parallel to the row of apertures. Within the scope of the invention, the expression "parallel to the row of apertures" is to be understood to include also embodiments in which the grooves extend substantially parallel to the row of apertures, i.e. the positioning grooves may be inclined at a small angle to the row of apertures. FIGS. 14A and 14B show details of embodiments in which the grooves are inclined at a small angle to the row of apertures. FIG. 14A shows a pair of wire cathodes and a detail of the wire-cathode support. FIG. 14B is a sectional view of the grooves. The wire cathodes are interconnected by means of a connecting element. The grooves are inclined at a small angle to the row of apertures. The advantage of such a construction is that the wire cathodes in such an oblique groove are drawn into the groove by the tensioning springs.

Figure 15B:
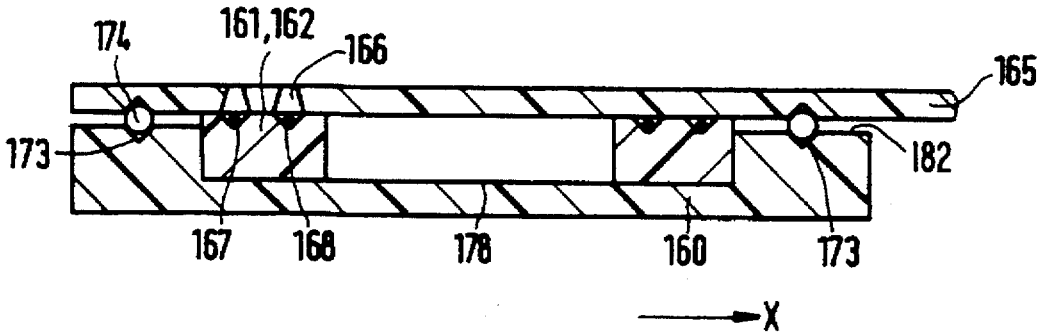
FIGS. 15A and 15B shows details of an embodiment of the display device in accordance with the invention.
Figure 15A:
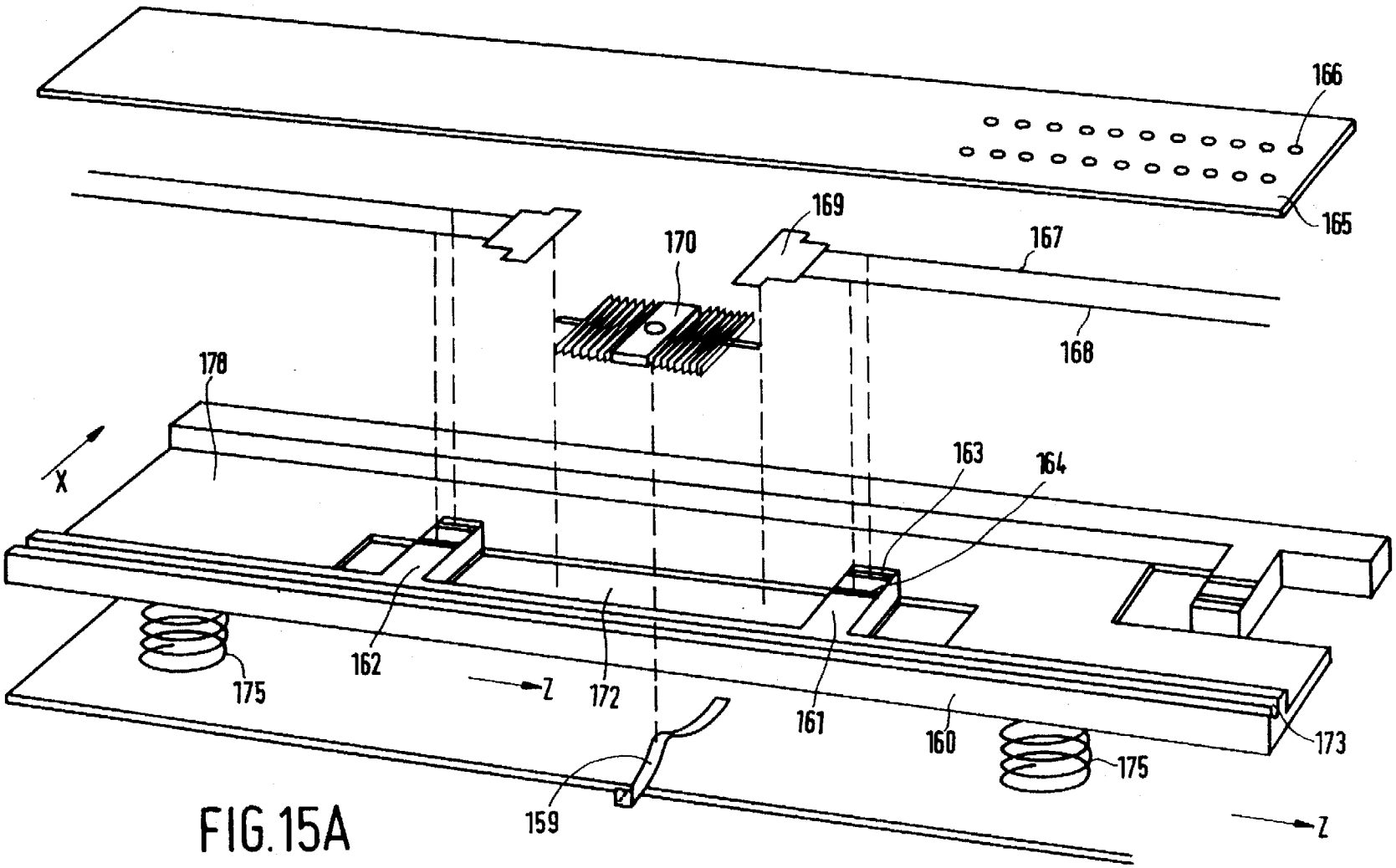

FIGS. 15A and 15B are, respectively, a detailed perspective view and a detailed sectional view of a number of elements of the display device in accordance with an embodiment of the invention. Wire-cathode support 160 comprises contacting surfaces 161 and 162 having wire-positioning grooves 163, 164. Via these contacting surfaces 161, 162, the wire-cathode support 160 engages the plate 165 which comprises rows of apertures 166. Wire cathodes 167, 168 are positioned in the grooves 163, 164. The wire cathodes are interconnected by coupling elements 169. These coupling elements are interconnected by tensioning springs 170. The wire-cathode support is provided with an aperture 172, between the positioning grooves, for securing tensioning springs to the wire cathodes, in this example to the coupling elements. It is preferred, but not necessary, that the support is provided with such a mounting aperture. A sectional view (FIG. 15B) shows that the support 160 surrounds the wire cathodes 167, 168. Such a U-shaped construction is preferred because, by virtue thereof, the wire-cathode support forms a rigid construction in the x-direction and protects the wire cathodes to some extent. The wire-cathode support comprises edges 182. These edges are somewhat ground off relative to the contacting surfaces 161, 162, as is clearly shown in FIG. 15B. This has the advantage that the wire-cathode support 160 and the plate 165 only contact each other via the contacting surfaces 161, 162. The plates 165 and the edges 182 comprise support-positioning grooves 173 and fibres 174. They enable a good positioning in the x-direction to be attained. By virtue thereof, the accuracy with which the distance between the wire cathodes and the plate 165 is determined is improved relative to an embodiment in which also the edges are used as contacting surfaces. The support is flexible in the z-direction, but rigid in the x and y-directions. The wire-cathode support is pressed against the plate 165 by means of pressure springs 175. The rear wall 178 of the wire-cathode support is preferably provided with a layer which is capable of removing electric charges, for example a resistance layer. By virtue thereof, charging of the wire-cathode support is precluded and/or reduced. Such charging can adversely affect the emission of electrons by the wire cathode(s).

It will be obvious that within the scope of the invention many variations are possible to those skilled in the art.

It is noted that a number of the above-mentioned aspects (particularly interconnecting of wire cathodes on a wire-cathode support by means of tensioning springs and/or by means of connecting elements to pair-wise interconnect wire cathodes, the use of two different types of springs on the wire-cathode support to stretch the wire cathode(s) and to arrange the wire cathode(s) in the grooves, the use of a wire-cathode support on which all wire cathodes are secured, the use of a wire-cathode unit comprising the wire-cathode support as well as the apertured wall and, optionally, getters, the U-shaped wire-cathode support, providing the rear wall of the wire-cathode support with a layer which precludes electric charging, the use of springs which are shaped so that, the wire cathodes engage the groove in the hot state but not in the cold state) can be combined in a very favourable manner with the use of a wire-cathode support comprising contacting surfaces via which this wire-cathode support engages the apertured wall, as described above, and said aspects also offer advantages other than the shape and the location of the means used to position the wire-cathode support relative to the apertured wall. As regards these aspects, the aspect that "said element and the wire-cathode support engage each other on corresponding contacting surfaces which extend parallel to the row of apertures" can be interpreted in a broad sense to mean "that the display device comprises means for positioning said element and the wire-cathode support relative to each other".

We claim:

1. A display device having an envelope comprising a wire cathode for emitting electrons and an element having a planar surface with a row of apertures for allowing passage of electrons emitted by the wire cathode, characterized in that the display device comprises at least one wire-cathode support, in that the element and the wire-cathode support engage each other on corresponding contacting surfaces of which the normal extends transversely to the row of apertures, and in that said wire-cathode support has a number of wire-positioning grooves between which the wire cathode extends in a self-supporting manner and at a predetermined distance from the planar surface, said positioning grooves extending in a direction substantially parallel to the row, and means for longitudinally pretensioning the wire cathode without substantially forcing the wire cathode against the grooves, thereby permitting longitudinal movement within the grooves.

2. A display device as claimed in claim 1, characterized in that the display device comprises a separate pressure means for urging the wire-cathode support and said element against each other.

3. A display device as claimed in claim 2, characterized in that said pressure means comprises a spring.

4. A display device as claimed in claim 1 or 2, characterized in that the wire-cathode support is flexible in a direction along the row of apertures.

5. A display device as claimed in claim 1 or 2, characterized in that said element and the wire-cathode support are provided with additional support-positioning means to determine the relative positions of the wire-cathode support and said element in a direction transverse to the normal to the contacting surfaces.

6. A display device as claimed in claim 1 or 2, characterized in that the positioning grooves are formed in flexible elements of the wire-cathode support.

7. A display device as claimed in claim 1 or 2, characterized in that the positioning grooves extend in a side of the wire-cathode support facing the row of apertures.

8. A display device as claimed in claim 7, characterized in that the positioning grooves are formed in contacting surfaces of the wire-cathode support.

9. A display device as claimed in claim 1 or 2, characterized in that the positioning grooves comprise two surfaces which extend so as to form a sharp corner.

10. A display device as claimed in claim 1 or 2, characterized in that the wire-cathode support supports at least two parallel wire cathodes and in that said element comprises rows of apertures corresponding to said at least two wire cathodes.

11. A display device as claimed in claim 8, characterized in that the display device comprises more than one wire cathode and all wire cathodes are situated on one wire-cathode support.

12. A display device as claimed in claim 1 or 2, characterized in that a pre-tension is exerted on the wire cathode situated in the wire-positioning grooves, said pre-tension comprising a component in the longitudinal direction of the wire cathode and a component extending transversely to said direction.

13. A display device as claimed in claim 12, characterized in that the wire-cathode support is provided with tensioning springs which produce the pre-tension exerted on the wire cathode.

14. A display device as claimed in claim 13, characterized in that a tensioning spring is secured to and between two wire cathodes.

15. A display device as claimed in claim 14, characterized in that a tensioning spring is secured to and between two pairs of wire cathodes.

16. A display device as claimed in claim 13, characterized in that at least two positioning grooves have a common tensioning spring.

17. A display device as claimed in claim 14, characterized in that at least two positioning grooves have a common tensioning spring.

18. A display device as claimed in claim 15, characterized in that at least two positioning grooves have a common tensioning spring.

* * * * *